US008200130B2

(12) United States Patent
Maeyama et al.

(10) Patent No.: US 8,200,130 B2
(45) Date of Patent: Jun. 12, 2012

(54) DEVELOPMENT DEVICE AND IMAGE FORMING APPARATUS USING THE SAME

(75) Inventors: Takeshi Maeyama, Ikeda (JP); Toshiya Natsuhara, Takarazuka (JP); Junya Hirayama, Takarazuka (JP); Shigeo Uetake, Takatsuki (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 251 days.

(21) Appl. No.: 12/592,790

(22) Filed: Dec. 2, 2009

(65) Prior Publication Data

US 2010/0143002 A1 Jun. 10, 2010

(30) Foreign Application Priority Data

Dec. 5, 2008 (JP) ..... 2008-310686

(51) Int. Cl.
*G03G 15/08* (2006.01)

(52) U.S. Cl. ..... 399/279; 399/281

(58) Field of Classification Search ..... 399/279, 399/281, 283, 285
See application file for complete search history.

(56) References Cited

FOREIGN PATENT DOCUMENTS

| | | |
|---|---|---|
| JP | 05-150636 | 6/1993 |
| JP | 2005-037523 | 2/2005 |

*Primary Examiner* — David Gray
*Assistant Examiner* — Erika J Villaluna
(74) *Attorney, Agent, or Firm* — Brinks Hofer Gilson & Lione

(57) ABSTRACT

In a hybrid development method using a plurality of toner carriers, a development device and image forming apparatus are provided, wherein high image quality in which toner density is not reduced even in the case of high speed printing and the occurrence of development hysteresis (ghost) is controlled is ensured by accelerating the collection of the post-development residual toner on the toner carrier. The counter-charge having occurred in the developer remains in the developer without decreasing to disappear until the developer moves to the second toner carrier on the downstream-side, wherein this counter-charge is caused by supplying toner to the first toner carrier upstream in the rotating direction of the developer carrier.

7 Claims, 5 Drawing Sheets

DEVELOPMENT DEVICE AND IMAGE FORMING APPARATUS USING THE SAME

This application is based on Japanese Patent Application No. 2008-310686 filed on Dec. 5, 2008, in Japanese Patent Office, the entire content of which is hereby incorporated by reference.

TECHNICAL FIELD

The present invention relates to a development device including: a plurality of toner carriers for developing a latent image formed on an image carrier using a toner carried and conveyed on the surface thereof; and a developer carrier for supporting developer thereon and conveying the developer to supply toner in the developer to the plurality of aforementioned toner carriers. The present invention also relates to an image forming apparatus provided with the aforementioned development device.

BACKGROUND

In an image forming apparatus using the electrophotographic method, the single-component developing method using toner alone and the two-component developing method using both toner and carrier have been known as a development method for developing an electrostatic latent image formed on an image carrier.

In the single-component developing method, generally, toner is made to pass through a regulating section formed by a toner carrier and a regulating plate pressed against the toner carrier, whereby the toner is charged and a desired thin toner layer is obtained. This method has advantages of simplification, downsizing and cost reduction of the apparatus.

In the meantime, toner deterioration tends to be accelerated by the heavy stress at the regulating section, and toner charge-acceptance ability tends to be reduced. Further, the regulating member as a charge providing member for providing charge to the toner and the surface of the toner carrier are contaminated with the toner or external additive agent, whereby the charge-providing ability for providing charge to the toner is also reduced. This will reduce the amount of toner charge and will cause fogging and related problems, with the result that the service life of the development device is reduced.

Comparison reveals that, the two-component developing method is advantageous to realize a longer service life since the toner is mixed with a carrier to be charged by triboelectric charging, thereby causing less stress, and since the carrier is not easily contaminated with toner or external additives because of a greater area of its surface.

However, in the two-component developing method, when an electrostatic latent image on the image carrier is to be developed, the image carrier surface is brushed by a magnetic brush formed of the developer. This may create a problem that a mark of the magnetic brush remains on a developed image. Further, the carrier tends to be attached to the image carrier, whereby an image defect occurs.

The so-called hybrid development method was disclosed (e.g., Japanese Patent Application Publication No. H05-150636) as a development method that provides image quality as high as that of the single-component developing method, and solves the problem of image defect, and this method is characterized by a long service life achieved by the two-component developing method using a two-component developer. In this hybrid development method, a two-component developer is carried on the developer carrier, and only the toner is supplied from the two-component developer to the toner carrier.

However, the hybrid development method described in the Japanese Patent Application Publication No. H05-150636 includes such problems as reduction in density at the time of high-speed development or occurrence of development hysteresis (ghost).

The reduction in density at the time of high-speed development refers to the problem wherein, when high-speed image formation has been practiced, the toner traveling speed cannot catch up with the development nip time, with the result that image density is reduced.

The usual one-component development method has been used only in the range of a low speed, since it has a problem, which is also found in the non-contact one-component development, that a heavy stress is applied to the toner, thereby causing heat and fusion of toner at the regulating section. For that reason, that problem has not been thought to be a big problem. The hybrid development method is free of these problems, and realizes image forming at a considerably high speed. For example, in an apparatus wherein the system speed exceeds 500 mm/s, the aforementioned problem does not arise.

The problem of development hysteresis (ghost) commonly occurs to the hybrid development method. The residual toner remaining on the toner carrier without being used for development appears on the image as development hysteresis (ghost) in the next development process.

In a portion (supply area) where the developer carrier for supplying toner to the toner carrier faces the toner carrier, the toner to be used for development is supplied, and collection of the residual toner is performed in the same opposing portion between the developer carrier and the toner carrier. In this case, bias is applied in the direction of supplying toner. This causes difficulties in collecting the residual toner, hence, insufficiency in collection capability. Thus, a greater amount of post-development residual toner is found in some areas while a smaller amount of post-development residual toner is observed in other areas. This difference in residual toner appears as the contrast of density in the next development process.

One of the techniques for solving the problem of reduction in density in the high-speed development mode is disclosed in the Japanese Patent Application Publication No. 2005-37523 and others where a plurality of toner carriers are provided to save time for the total development nip time required for jumping of the toner, whereby the toner density is ensured.

In the structure described in the Japanese Patent Application Publication No. 2005-37523, the toner jumps more than once. This allows a toner image to be positively formed on the photoreceptor, and suppresses the reduction in density of the toner image cause by high speed operation, even when the photoreceptor is rotated at a high speed. This structure reduces the amount of toner carried on each toner carrier compared to a structure having only one toner carrier. This reduces the density contrast between the portion where toner has been used for development and the portion wherein toner has not been used for development. Thus, occurrence of a ghost is kept to a considerably small degree, as disclosed.

However, the study made by the present inventors shows that the structure disclosed in the Japanese Patent Application Publication No. 2005-37523 fails to ensure a sufficient capability of collecting from the toner carrier the post-development residual toner. Thus, in the next toner supplying step, toner is supplied to the toner carrier having unevenness of toner density. Therefore, the contrast of density can be reduced to a certain extent but cannot be sufficiently reduced, and the ghost cannot be completely eliminated.

SUMMARY

In view of the technical problems described above, it is an object of the present invention to provide a high image quality development device in a hybrid development method using a plurality of toner carriers, and an image forming apparatus using the development device, wherein a reduction of density in the high-speed development mode and the occurrence of development hysteresis (ghost) are minimized by accelerating the collection of the post-development residual toner from the toner carrier.

In view of forgoing, one embodiment according to one aspect of the present invention is a developing device, comprising:

a first toner carrier for carrying toner on a surface thereof to develop with the toner an electrostatic latent image formed on a image carrier;

a second toner carrier for carrying toner on a surface thereof to develop with the toner the electrostatic latent image formed on the image carrier; and a developer carrier which is provided so as to face the first toner carrier and the second toner carrier and is adapted to carry developer in a thin layer shape on a surface thereof to supply toner contained in the developer to the first toner carrier and the second toner carrier, wherein the first toner carrier is disposed so as to face the developer carrier at upstream in a rotating direction of the developer carrier, and the second toner carrier is disposed so as to face the developer carrier at downstream in the rotating direction of the developer carrier, and counter-charge generated by the supply of toner from the developer on the developer carrier in the developer at a first facing area between the developer carrier and the first toner carrier remains without decreasing to disappear in the developer until the counter-charge is conveyed to a second facing area between the developer carrier and the second toner carrier.

According to another aspect of the present invention, another embodiment is an image forming apparatus, comprising:

an image carrier;

a latent image forming section for forming an electrostatic latent image on the image carrier;

a first toner carrier for carrying toner on a surface thereof to develop with the toner the electrostatic latent image on the image carrier;

a second toner carrier for carrying toner on a surface thereof to develop with the toner the electrostatic latent image formed on the image carrier; and a developer carrier which is provided so as to face the first toner carrier and the second toner carrier and is adapted to carry developer in a thin layer shape on a surface thereof to supply toner contained in the developer to the first toner carrier and the second toner carrier, wherein the first toner carrier is disposed so as to face the developer carrier at upstream in a rotating direction of the developer carrier, and the second toner carrier is disposed so as to face the developer carrier at downstream in the rotating direction of the developer carrier, and counter-charge generated by the supply of toner from the developer on the developer carrier in the developer at a first facing area between the developer carrier and the first toner carrier remains in the developer without decreasing to disappear until the counter-charge is conveyed to a second facing area between the developer carrier and the second toner carrier.

DETAILED DESCRIPTION OF THE PREFERRED EMBODIMENT

The following describes an embodiment of the present invention with reference to the drawings.

(Structure and Operation of the Image Forming Apparatus)

Figure 1:
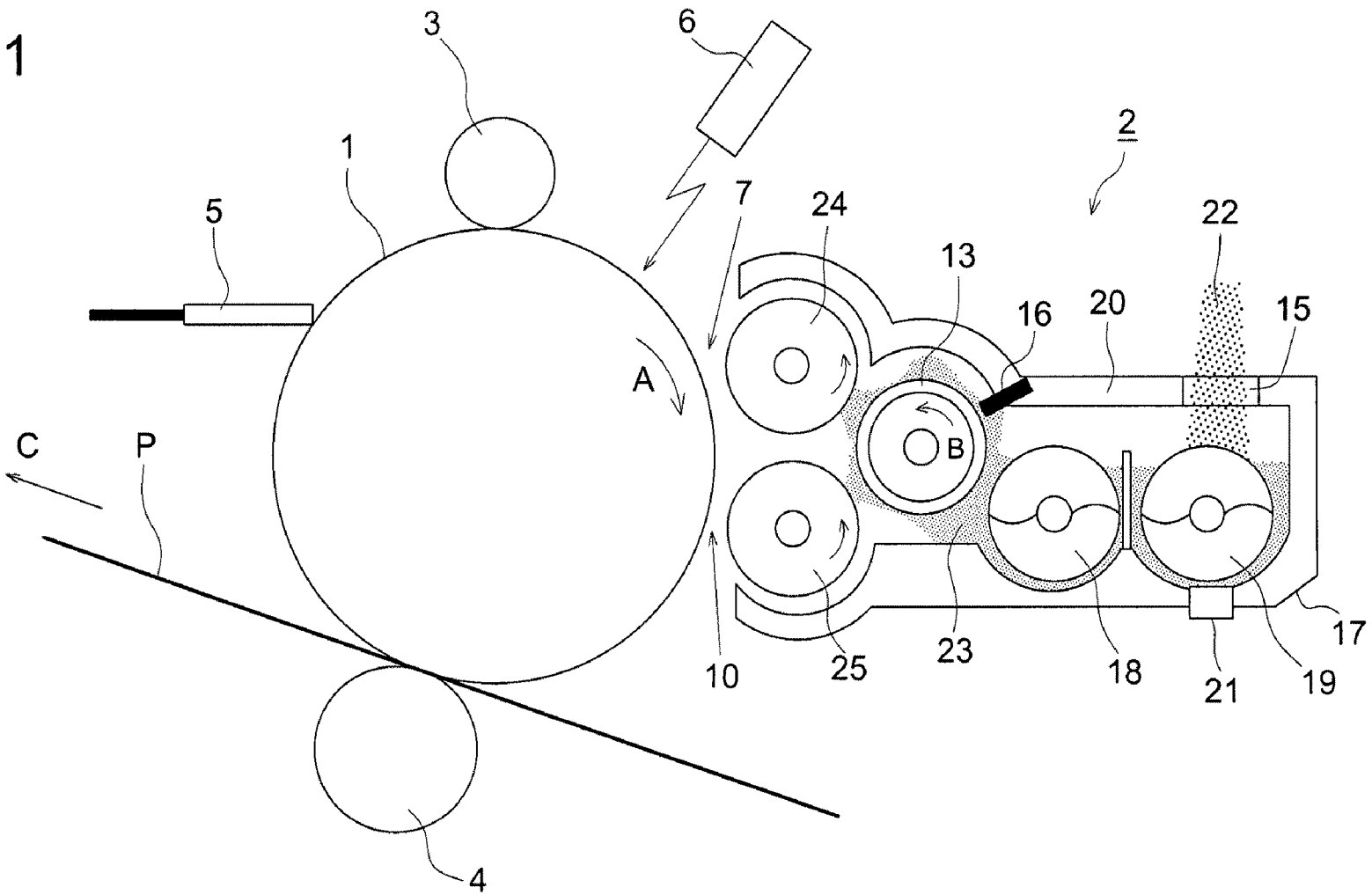
FIG. 1 is a diagram representing a structural example of the major portion of an image forming apparatus according to an embodiment of the present invention.

FIG. 1 is a diagram representing a structural example of the major portion of an image forming apparatus according to an embodiment of the present invention. The following describes the schematic structure and operation of the image forming apparatus in this embodiment with reference to FIG. 1.

This image forming apparatus is a printer where a toner image formed on an image carrier (photoreceptor) 1 by the electrophotographic method is transferred onto a transfer medium P such as a sheet of paper, whereby an image is formed.

This image forming apparatus includes the image carrier 1 for carrying an image, and around the image carrier there are arranged along the rotating direction A of the image carrier a charging member 3 as a charging means for charging the image carrier 1, a development device 2 for developing an electrostatic latent image on the image carrier 1, a transfer roller 4 for transferring a toner image on the image carrier 1, and a cleaning blade 5 for removing the toner remaining on the image carrier 1.

After having been charged by a charging member 3, the image carrier 1 is exposed to light by an exposure device 6 equipped with a laser emitting device, and thereby an electrostatic latent image is formed on the surface thereof. The development device 2 develops this electrostatic latent image so that a toner image is formed. After transferring the toner image on the image carrier 1 onto the transfer medium P, the transfer roller 4 ejects the transfer medium P in the direction of arrow C in FIG. 1. The cleaning blade 5 uses the mechanical force to remove the post-development residual toner remaining on the image carrier 1.

For the image carrier 1, charging member 3, exposure device 6, transfer roller 4 and cleaning blade 5 used in the image forming apparatus, any conventionally known electrophotographic technology can be used. For example, although a charging roller is shown in the drawing as a charging device, an image carrier 1 or non-contact charging device can be used. Further, a cleaning blade need not be used.

The following describes the structure of the basic portion of the development device 2 using the hybrid development method according to the present embodiment.

The development device 2 includes: a developer tank 17 for storing the developer 23 containing carrier and toner; a developer carrier 13 whose surface is used to carry and convey the developer 23 supplied from the developer tank 17; and a first and second toner carriers 24 and 25 for developing the electrostatic latent image formed on the image carrier 1 to which only toner is supplied from the developer carrier 13.

In the present embodiment, the first and second toner carriers are provided as described above. However, more than two toner carriers can be provided. In that case, the following description of the embodiment is applied if all the toner carriers are disposed facing the developer carrier 13, the upstream one in the rotating direction of the developer carrier is assumed as the first toner carrier, the downstream one is assumed as the second toner carrier, and the rest of the toner carriers are assumed to be disposed at any position.

The details of the structure and operations of the development device 2 will be described later.

(Structure of the Developer)

The following describes the structure of the developer used in the development device according to the present embodiment.

The developer 23 used in the present embodiment includes toner and carrier for charging the toner.

<Toner>

There is no particular restriction to the toner. Known toner commonly used can be utilized. Binder resin is impregnated with a coloring agent or, if required, with an electric charge control agent or a mold releasing agent, and is treated with an external additive agent. This product can be used as the toner. The diameter of toner particles is preferably from about 3 to 15 μm without being restricted thereto.

The aforementioned toner can be produced by the known method commonly used. For example, the pulverization method, emulsion polymerization method or suspension polymerization method can be used.

The binder resin to be used for the toner is exemplified by styrene based resin (homopolymer or copolymer including a substituted styrene or styrene), polyester resin, epoxy based resin, vinyl chloride resin, phenol resin, polyethylene resin, polypropylene resin, polyurethane resin, and silicone resin, without being restricted thereto. It is preferable to use the single substance or a complex of the aforementioned resins having a softening temperature from 80 to 160° C., or having a glass transition point from 50 to 75° c.

The known agent commonly use can be used as the coloring agent. Examples include carbon black, aniline black, activated carbon, magnetite, Beijing yellow, permanent yellow, naphthol yellow, phthalocyanine blue, first sky blue, ultra-marine blue, rose bengal, and lake red. They can be preferably used. Generally, the preferred ratio is from 2 to 20 parts by mass with respect to 100 parts by mass of the aforementioned binder resin.

The known material commonly used can be used as the aforementioned electric charge control agent. The electric charge control agent for positive charge toner is exemplified by a nigrosine based dye, quaternary ammonium salt based compound, triphenyl methane based compound, imidazole based compound and polyamine resin. The electric charge control agent for negatively charged toner is exemplified by metal-containing azo based dye such as Cr, Co, Al and Fe, metallic salicylate compound, metallic alkylsalicylate compound and calixarene compound. Generally, the preferred ratio of the electric charge control agent is from 0.1 to 10 parts by mass with respect to 100 parts by mass of the aforementioned binder resin.

The known agent commonly used can be used as the mold releasing agent. Polyethylene, polypropylene, carnauba wax or sazol wax can be used independently or in combination of two or more types. Generally, the preferred ratio is from 0.1 to 10 parts by mass with respect to 100 parts by mass of the aforementioned binder resin.

The known agent commonly used can be used as the aforementioned external additive agent. Examples include inorganic particles such as silica, titanium oxide and aluminum oxide, and such resin particles as acryl resin, styrene resin, silicone resin, and fluorine resin. Especially, the silane coupling agent, titanium coupling agent and silicone oil treated by hydrophobing are used with particular preference. It is preferred to add 0.1 through 5 parts by mass of such a superplasticizer with respect to 100 parts by mass of toner. The number average particle size of the external additive agent is preferably from 10 to 100 nm.

Particles charged oppositely to the toner can be used as the aforementioned external additive agent. Opposite polarity particles that are used preferably are selected as appropriate according to the polarity of the charged toner.

When a negative charge toner is used, positive charge particles are used as opposite polarity particles. They are exemplified by the particles made of inorganic particles of strontium titanate, barium titanate and alumina, thermoplastic resins including acryl resin, benzoguanamine resin, nylon resin, polyimide resin and polyamide resin, or thermosetting resins. Further, the resin can contain a positive charge control agent for providing a positive charge, or a copolymer of nitrogen-containing monomer can be formed.

Nigrosine dye or quaternary ammonium salt can be used as the aforementioned positive charge control agent, and 2-dimethylaminoethyl acrylate, 2-diethylaminoethyl acrylate, 2-dimethylaminoethyl methacrylate, 2-diethylaminoethyl methacrylate, vinyl pyridine, N-vinyl carbazole or vinyl imidazole can be used as the aforementioned nitrogen-containing monomer.

On the other hand, when a positive charge toner is used, negative charge particles can be employed as opposite polarity particles. For example, in addition to the inorganic particles of silica, titanium oxide or others, it is possible to utilize the particles made of a thermoplastic resin such as fluorine resin, polyolefin resin, silicone resin and polyester resin, or the thermosetting resin. Alternatively, the resin can be impregnated with a negative charge control agent for providing negative charge. It is also possible to constitute a copolymer made of fluorine-containing acryl based monomer and fluorine-containing methacrylate based monomer. For example, the salicylic based acid, the naphthol based chromium complex, aluminum complex, iron complex or zinc complex can be used as the aforementioned negative charge control agent.

To regulate the charging properties and hydrophobicity of the opposite polarity particles, the surface of the inorganic particles can be treated with a silane coupling agent, titanium coupling agent or silicone oil. Especially in order to provide inorganic particles with positive charge property, surface treatment with an amino acid-containing coupling agent is preferably provided. In order to provide inorganic particles with negative charge property, surface treatment with a fluorine group-containing coupling agent is preferably provided.

Opposite polarity particles preferably have a number average particle size from 100 to 1000 nm, and are preferably added at the ratio from 0.1 to 10 parts by mass with respect to 100 parts by mass of toner.

<Carrier>

The known carrier commonly used can be used as the carrier without being restricted thereto. A binder type carrier or coat-type carrier can be used. The preferred diameter of the carrier is from 15 to 100 μm without being restricted thereto.

The binder type carrier is made of particles of magnetic substance dispersed in the binder resin. Positive or negative charge particles can be bonded onto the carrier surface, or a surface coating layer can be formed. The charging properties such as polarity of the binder type carrier can be controlled by adjusting the material of the binder resin, electrostatic particles and the type of surface coating layer.

The binder resin used in the binder type carrier is exemplified by thermoplastic resin such as the vinyl based resin represented by polystyrene based resin, polyester based resin, nylon based resin and polyolefin based resin, as well as thermosetting resin such as a phenol resin.

The magnetic particles of the binder type carrier that can be employed include particles of magnetite, spinel ferrite such as gamma iron oxide, spinel ferrite containing one or more types of metals (e.g., Mn, Ni, Mg and Cu) other than iron, magnetoplumbite type ferrite such as barium ferrite, and the iron or alloy having an oxide layer on the surface. These particles can be formed in any configuration—granular, globular or, acicular. Especially when a high degree of magnetic force is required, iron based ferromagnetic particles are preferably used. Further, when consideration is given to the chemical stability, it is preferred to use the ferromagnetic particles of magnetoplumbite type ferrite such as magnetite, spinel ferrite containing gamma iron oxide or barium ferrite. A magnetic resin carrier characterized by a desired magnetism can be produced by proper selection of the type and amount of ferromagnetic particles to be contained therein. The preferred amount of the magnetic particles to be added into the magnetic resin carrier is from 50 to 90% by mass.

A silicone resin, acryl resin, epoxy resin or fluorine based resin is used as the surface coating material of the binder type carrier. When these resins are coated and hardened on the surface to form a coating layer, the charge-providing ability is improved.

In the process of bonding electrostatic particles or conductive particles onto the surface of the binder type carrier (the magnetic resin carrier), the magnetic resin carrier is uniformly mixed with those particles to be bonded to attach those particles onto the surface of the magnetic resin carrier. After that, mechanical or thermal impact is applied so that the particles are injected into the magnetic resin carrier and are fixed in position. In this case, the particles are not completely embedded into the magnetic resin carrier. Instead, part of the particles is kept protruded from the surface of the magnetic resin carrier.

Organic or inorganic insulating materials are used as electrostatic particles. To put it more specifically, examples of the organic material include organic insulating particles made of polystyrene, styrene based copolymer, acryl resin, various forms of acryl copolymer, nylon, polyethylene, polypropylene, and fluorine resin or cross-linked substances thereof. A desired degree of charging and polarity can be obtained by the selection of proper materials, use of a polymerization catalyst and surface treatment. Examples of the inorganic material include negative charge inorganic particles made of silica or titanium dioxide, and positive charge particles made of strontium titanate or alumina.

On the other hand, the coat-type carrier is formed of resin-coated carrier core particles of magnetic substances. Similarly to the case of the binder type carrier, the coat-type carrier is formed by the process of bonding the positive or negative charge particles to the carrier surface. The charging properties of the coat-type carrier such as polarity can be controlled by proper selection of the type of the surface coating layer and electrostatic particles. The same material as that of the binder type carrier can be used. The same resin as the binder resin of the binder type carrier can be used as the coated resin, in particular.

The mixture ratio of the toner to carrier should be adjusted to get a desired amount of toner charge. The toner mixture ratio is from 3 to 50% by mass, preferably, 6 to 30% by mass with respect to the total amount of toner and carrier.

(Structure and Operation of Development Device 2)

Figure 2:
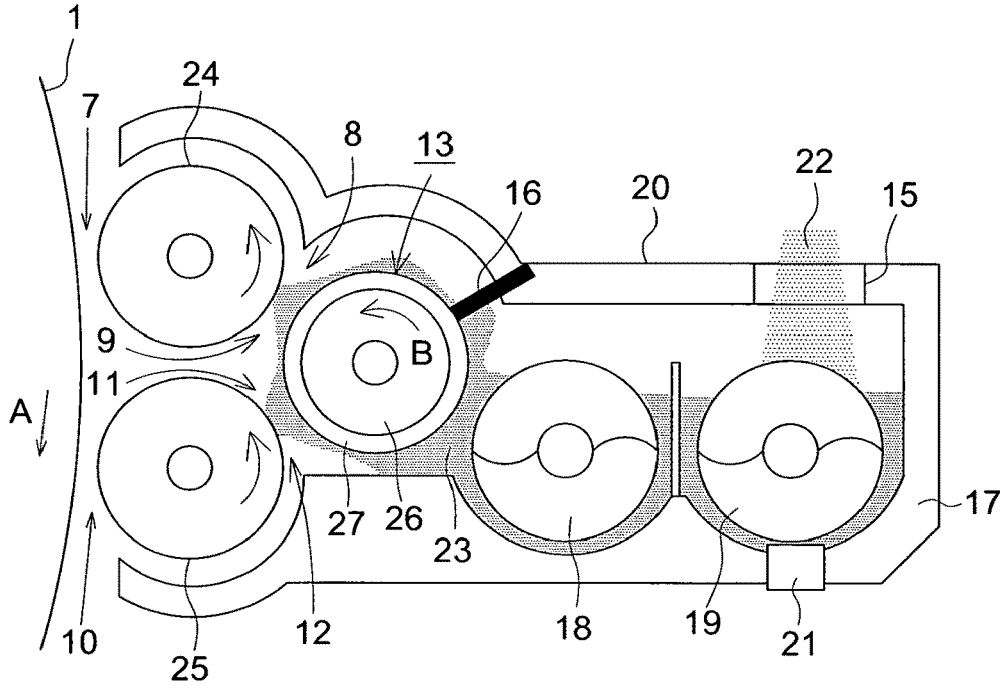
FIG. 2 is an enlarged view of the structural example of a development device 2 in FIG. 1.

FIG. 2 is an enlarged view of the structural example of the development device 2 in FIG. 1. Referring to FIG. 2, the following describes the details of the structure and operation of the development device 2 in the present embodiment.

<Apparatus Structure>

As described above, the developer 23 used in the development device 2 is made of toner and carrier and is stored in a developer tank 17.

The developer tank 17 is made of a casing 20. Mixing/stirring members 18 and 19 are generally incorporated in the developer tank 17. The mixing/stirring members 18 and 19 are used to mix and stir the developer 23, and to supply the developer 23 to a developer carrier 13. An ATDC (Automatic Toner Density Control) sensor 21 for toner density detection is preferably installed on the casing 20 at the position opposed to the mixing/stirring member 19.

The development device 2 generally includes a replenishment section 15 for replenishing into the developer tank 17 the amount of toner to be consumed by the image carrier 1. In the replenishment section 15, the replenishment toner 22 supplied from a hopper (not illustrated) incorporating the replenishment toner is supplied into the developer tank 17. The operation of replenishment should be controlled based on the output of the ATDC sensor 21.

The development device 2 is provided with a regulating member 16 for reducing the thickness of the developer and regulating the amount of developer on the developer carrier 13.

The developer carrier 13 is normally made of a magnetic roller 26 fixedly disposed in position, and a freely rotatable sleeve roller 27 containing the roller 26. In the image formation mode, a toner supply bias is applied to supply toner to the toner carrier.

<Structure of Toner Carrier>

Two toner carriers 24 and 25 are arranged facing both the developer carrier 13 and image carrier 1, and a development bias is applied to develop the electrostatic latent image on the image carrier 1.

The toner carriers 24 and 25 can be made of any material, as long as the aforementioned voltage can be applied. Examples include an aluminum roller provided with surface treatment exemplified by alumite. Further, the toner carriers can be made of the conductive substrate of aluminum that is coated with resin such as polyester resin, polycarbonate resin, acryl resin, polyethylene resin, polypropylene resin, urethane resin, polyamide resin, polyimide resin, polysulfone resin, polyether ketone resin, vinyl chloride resin, vinyl acetate resin, silicone resin or fluorine resin; or is coated with rubber such as silicone rubber, urethane rubber, nitrile rubber, naturally-occurring rubber or isoprene rubber. In this case, the coating material is not restricted to these materials.

Further, a conductive agent can be added to the bulk or surface of the aforementioned coating. The conductive agent is exemplified by an electron-conductive agent and ion-conductive agent. Examples of the electron-conductive agent include carbon black such as Ketzin black, acetylene black and furnace black; metallic powder; and particles of metallic oxides without the conductive agent being restricted thereto. Examples of ion-conductive agents include cationic compound such as quaternary ammonium salt, amphoteric compound, and other ionic polymeric materials without the ionic conductive agent being restricted thereto. Further, a conductive roller made of a metallic material such as aluminum can be used.

<Operation of Apparatus>

Referring to FIG. 2, the following describes examples of operations of the development device 2 in detail.

The developer 23 in the developer tank 17 is mixed and stirred by the rotation of the mixing/stirring members 18 and 19, and is subjected to triboelectric charging. At the same time, the developer 23 is circulated inside the developer tank 17 to be supplied to a sleeve roller 27 on the surface of the developer carrier 13.

The developer 23 is held on the surface of the sleeve roller 27 by the magnetic force of the magnetic roller 26 inside the developer carrier 13, and is rotated and moved together with the sleeve roller 27, and the amount of the developer 23 is then regulated by the regulating member 16 disposed facing the developer carrier 13.

After that, the developer 23 is conveyed to a first toner supply area 8 opposed to the first toner carrier 24.

In the first toner supply area 8 that is a portion, downstream in the rotating direction of the toner carrier, in the opposing portion where the first toner carrier 24 faces the developer carrier 13, the toner in the developer 23 is supplied to the first toner carrier 24 by a force given to the toner by the electric field formed by the potential difference between the development bias applied to the first toner carrier 24 and toner supply bias applied to the developer carrier 13.

Generally, the first toner carrier 24 is applied with a bias in which an AC voltage is superposed on the DC voltage, and the developer carrier 13 is applied with a bias of a DC voltage alone, or a bias in which an AC voltage is superposed on the DC voltage. Thus, in the first toner supply area 8, there is formed an electric field of an AC electric field superposed on a DC electric field.

In the first toner collection area 9 that is a portion, upstream in the rotating direction of the toner carrier, in the opposing portion where the first toner carrier 24 faces the developer carrier 13, the post-development residual toner is collected by a collecting action which is caused, to the post-development residual toner, by the developer on the developer carrier 24.

The remaining developer 23 having passed through the first toner supply area 8 and first toner collection area 9 is rotated and moved together with the sleeve roller 27 of the developer carrier 13, and is conveyed to a second toner supply area 11 opposed to the second toner carrier 25.

In the second toner supply area 11 that is a portion, downstream in the rotating direction of the toner carrier, in the opposing portion where the second toner carrier 25 faces the developer carrier 13, similarly to the case of the first toner supply area 8, the toner in the developer 23 is supplied to the second toner carrier 25 by a force given to the toner by the electric field formed by the potential difference between the development bias applied to the second toner carrier 25 and toner supply bias applied to the developer carrier 13.

Similarly to the case of the first supply area 8, generally, the second toner carrier 25 is applied with a bias in which an AC voltage is superposed on a DC voltage, and the developer carrier 13 is applied with a bias of a DC voltage alone, or a bias in which an AC voltage is superposed on a DC voltage. Thus, in the second toner supply area 11, there is formed an electric field in which an AC electric field is superposed on a DC electric field.

In the second toner collection area 12 that is a portion, upstream in the rotating direction of the toner carrier, in the opposing portion where the second toner carrier 25 faces the developer carrier 13, similarly to the case of the first toner collection area 9, the post-development residual toner is collected by a collecting action caused, to the post-development residual toner, by the developer on the developer carrier 13.

In FIG. 2, the developer carrier 13, first toner carrier 24 and second toner carrier 25 are set to rotate in the same direction. Both the first toner carrier 24 and second toner carrier 25 can be set to rotate in the direction opposite to the developer carrier 13. Alternatively, one of the first toner carrier 24 and second toner carrier 25 can be set to rotate in the opposite directions.

When they are rotated in the same direction as shown in FIG. 2, the traveling direction of the developer carrier 13 is opposite to the traveling direction of the toner carriers 24 and 25 in the opposing portions therebetween.

In the hybrid development method, it is important to collect, before the next toner supply operation, the post-development residual toner as much as possible thereby minimizing the contrast in density between the portion where the toner has been used for development and the portion where the toner has not been used for development, in order to minimize the occurrence of a development hysteresis (ghost). The case where the developer carrier 13 and toner carriers 24 and 25 are rotated in the opposite direction in the opposing portions has an advantage in collecting the post-development residual toner in that the relative speed, hence, mechanical force for collecting toner is greater, and an electric force for collecting toner is generated by the counter-charge having been produced in the toner supply area as will be described in detail later.

Thus, the developer carrier 13 and the toner carriers 24 and 25 are preferably set to travel in the opposite directions in the opposing portions therebetween, because this will reduce the development hysteresis (ghost).

In the second supply area 11, the toner in the developer 23 is used in the first supply area 8, and is reduced in amount. This may cause reduction in the toner supply performance. Thus, if the distance between the second toner carrier 25 and developer carrier 13 at the closest portion is set to be smaller than the distance between the first toner carrier 24 and developer carrier 13 at the opposing portion, it is possible to make up for the reduction in supply performance.

The toner layer supplied, onto the first toner carrier 24, from the developer carrier 13 in the first toner supply area 8 is conveyed to the first development area 7 by the rotation of the first toner carrier 24. This toner layer is used for the first development by the electric field formed by the development bias applied to the first toner carrier 24 and the potential of the latent image on the image carrier 1.

In the first development area 7, development is performed with the toner moved by the electric field through the development space between the first toner carrier 24 and image carrier 1.

Various forms of known bias can be used as the development bias. The bias generally applied is a bias in which an AC voltage is superposed on a DC voltage. After that, the toner layer remaining subsequent to development where toner has been consumed in the first development area 7 is conveyed to the first toner collection area 9 by the rotation of the first toner carrier 24.

Similarly, the toner layer supplied, onto the second toner carrier 25, from the developer carrier 13 in the second toner supply area 11 is conveyed to the second development area 10 by the rotation of the second toner carrier 25. This toner layer is used for the second development by the electric field formed by the development bias applied to the second toner carrier 25 and the potential of the latent image on the image carrier 1.

Similarly to the case of the first development area 7, in the second development area 10, development is performed with the toner moved by the electric field through the development space between the second toner carrier 25 and image carrier 1.

Various forms of known bias can be used as the development bias. T bias normally applied is a bias in which an AC voltage is super posed on a DC voltage. After that, the toner layer remaining subsequent to development where toner has been consumed in the second development area 10 is conveyed to the second toner collection area 12 by the rotation of the second toner carrier 25.

The developer 23 having passed through the second toner collection area 12 is conveyed to the developer tank 17 with the rotation of the sleeve 27, and is separated from the developer carrier 13 by the repulsive magnetic field provided on the magnetic roller 26 corresponding to the position of the developer collection area 14. Then the developer 23 is collected into the developer tank 17.

When the replenishment control section (not illustrated) provided on the replenishment section 15 has determined from the output value of the ATDC sensor 21 that the toner concentration in the developer 23 is reduced below the minimum toner concentration required to ensure the image density, the replenishment toner 22 stored in the hopper is supplied, by the toner replenishment device (not illustrated), into the developer tank 17 through the toner replenishment section 15.

In the aforementioned embodiment, the first toner carrier performs the first development and the second toner carrier performs the second development.

When consideration is given to facilitate the collection of toner hence the reduction in the occurrence of ghosts by using the counter-charge (to be described later), arrangements are preferably made in such a way that the first toner carrier develops the latent image before the second toner carrier does, as described above.

The counter-charge having occurred in the toner supply area corresponding to the first toner carrier contributes to accelerate the collection of the toner in the toner collection area corresponding to the second toner carrier. Thus, the ghost to be occurred by the second toner carrier, which develops the latent image later than the first toner carrier, is reduced. This ensures that the effect of reducing the occurrence of ghosts is increased as a whole.

The following describes the acceleration of the toner collection and the reduction of the occurrence of ghosts by using counter-charge.

(Accelerating Toner Collection by Using Counter-Charge)

The following describes the further details of the phenomena in the toner supply areas and the toner collection areas in the vicinity of the opposing portions between the developer carrier and respective the toner carriers.

Figure 3:
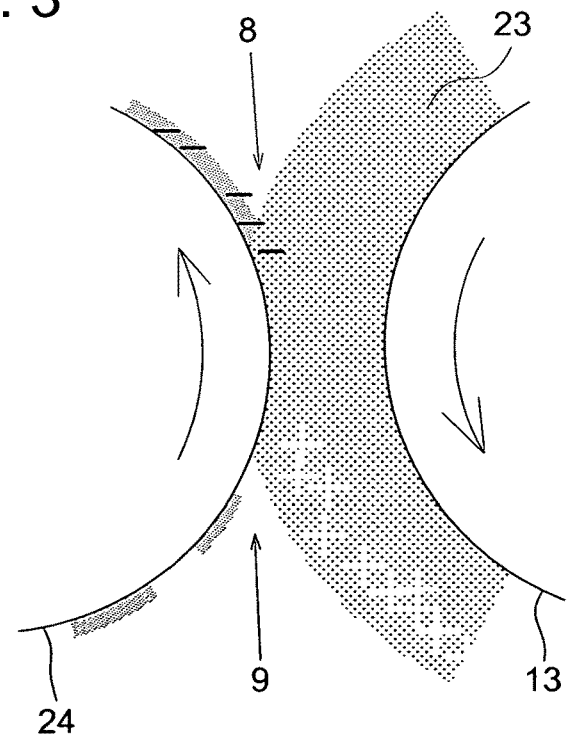
FIG. 3 is an enlarged view showing the periphery of the opposing portion when a first toner carrier 24 and a developer carrier 13 of the development device 2 rotate in the same direction.

FIG. 3 is an enlarged view showing the periphery of the opposing portion of the first toner carrier 24 and developer carrier 13. In the first toner supply area 8, only the toner is supply to the first toner carrier 24 from the developer 23 having been conveyed on the surface of the developer carrier 13.

In this case, assuming that the toner is negatively charged, since only the negatively charged toner moves to the first toner carrier 24 from the developer 23, electric neutrality is lost in the surface portion of the developer 23 deprived of toner, and the positive charge on the carrier becomes excessive. The positive charge remaining excessively in the developer 23 subsequent to removal of toner is referred to as counter-charge.

When this counter-charge has been conveyed to the first toner collection area 9 without decreasing to disappear in the developer 23 because of a high resistance of the carrier or others, the counter-charge attracts the negatively charged post-development residual toner, hence, assists collection of the post-development residual toner, thereby contributing to the solution of the problem involving development hysteresis (ghost).

In actual practice, this contribution can be expected when the surfaces of the first toner carrier 24 and developer carrier 13 travel in the opposite directions, as shown in FIG. 3. To be more specific, in the case of traveling in the opposite directions, the developer 23 is conveyed to the toner collection area 9 after having been used for the toner supply in the toner supply area 8. Thus, if the counter-charge does not decrease to disappear during the conveyance from the toner supply area 8 to the toner collection area 9, collection of toner can be accelerated by the counter-charge in the toner collection area 9.

Figure 4:
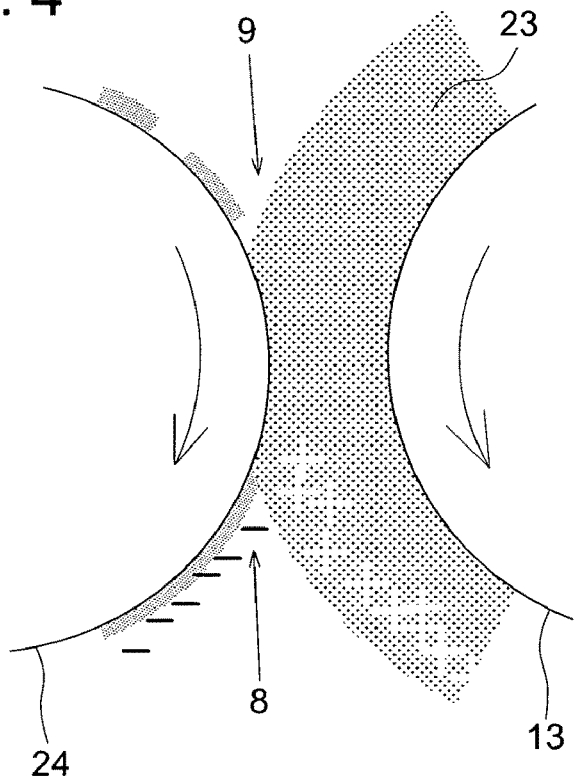
FIG. 4 is an enlarged view showing the periphery of the opposing portion when the first toner carrier 24 and the developer carrier 13 of the development device 2 rotate in opposite directions.

Conversely, if the surfaces of the first toner carrier 24 and developer carrier 13 travel in the same direction, as shown in FIG. 4, the developer 23 moves to the toner supply area 8 after collecting toner in the toner collection area 9, and toner supply is then performed. Thus, it is not impossible to use the possible counter-charge in the toner collection area 9 to accelerate the toner collection.

This shows that the surfaces of the first toner carrier 24 and developer carrier 13 preferably travel in the opposite directions from the viewpoint of solving the problem of development hysteresis (ghost). This description applies not only to the rotating direction of the first toner carrier 24 and developer carrier 13, but also to the rotating direction of the second toner carrier 25 and developer carrier 13.

The present description assumes that the toner is negatively charged. But even in the case that the toner is positively charged, the similar description can be applied if the other polarities are considered as reversed. This idea is available when the toner is assumed to have some polarity in the subsequent description.

(Decreasing of the Counter-Charge Between Toner Carriers)

In the development device 2 according to the hybrid development method of the present embodiment, two or more toner carriers are used. This structure includes a plurality of development areas, whereby sufficient development capability is ensured even if the apparatus speed has been increased, without the image density being sacrificed. The object of reducing the development hysteresis (ghost) as a problem with the hybrid development can be achieved by assigning the following conditions to this structure.

The aforementioned conditions are intended to ensure that the counter-charge having occurred in the developer 23 in the first toner supply area 8 is maintained without decaying in the developer 23 until it decreases to disappear to the second toner collection area 12. Those conditions are used to accelerate the collection of the post-development residual toner on the second toner carrier 25, and to reduce the occurrence of development hysteresis (ghost).

Figure 5:
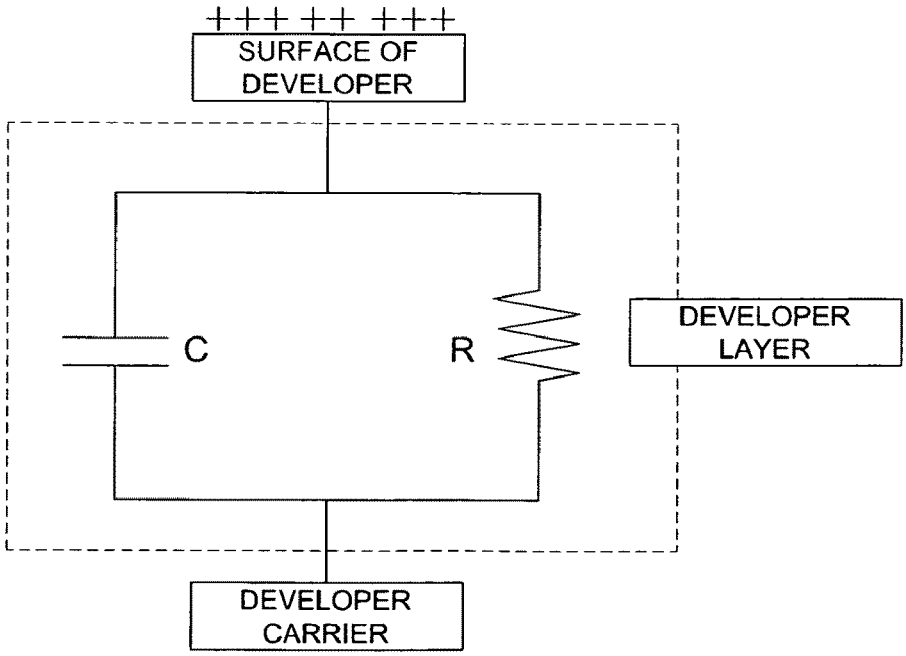
FIG. 5 is a diagram representing an equivalent circuit of a developer layer on a developer carrier 13.

FIG. 5 is a diagram representing the equivalent circuit of a developer layer on the developer carrier 13. In the first place, referring to FIG. 5, the following describes the phenomenon of the counter-charge decreasing in the developer 23.

The surface of the developer 23 on the developer carrier 13 deprived of the negative charge by removing the toner includes a positive counter-charge. This charge decreases with time in conformity to the time constant depending on the electrostatic capacitance and resistance of the layer of the developer 23.

Decreasing in this case is expressed by the following equation (1) when consideration is given to the decreasing in the equivalent circuit of FIG. 5.

Assume that V0 is the voltage of the developer layer surface produced by the counter-charge immediately after occurrence of the counter-charge, C is the capacitance of the developer layer, and R is the resistance of the developer layer, the voltage V(t) of the counter charge is expressed in Equation (1).

$$V(t)=V0\times\exp(-t/CR) \quad (1)$$

If the time t12 for the developer 23 to move from the opposing portion between the first toner carrier 24 and developer carrier 13 to the opposing portion between the second toner carrier 25 and developer carrier 13 is substituted into t of Equation (1), the coefficient "exp (−t12/CR)" (hereinafter referred to as "residual surface-potential ratio) must not decrease to approximately zero in order to carry the counter-charge to the second collection area 12 before the counter-charge decrease to disappear.

Figure 6:
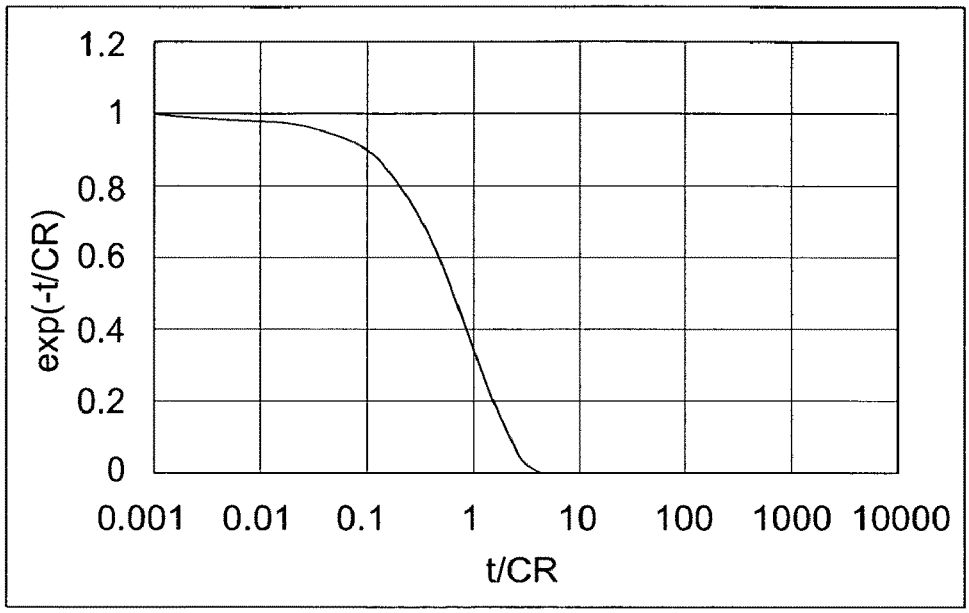
FIG. 6 is a chart representing the relationship between the damping time constant t/CR and residual surface-potential ratio exp (−t/CR)

FIG. 6 is a chart representing the relationship between t/CR in Equation (1) and the residual surface-potential ratio exp (−t/CR). The residual surface-potential ratio exp (−t/CR) begins to exhibit an abrupt rise when the t/CR has reduced below 10, and reaches a value close to 1 when the t/CR has reduced below 0.1.

This means that, when t satisfies t/CR≧10, the counter-charge has decreased to disappear and there is almost no remainder at that time t. When t satisfies t/CR<10, a part of the counter-charge remains at that time t. When t satisfies t/CR<0.1, the counter-charge remains almost without decreasing.

Thus, "t12/CR<10" is the requirement that must be satisfied in order to ensure that the counter-charge generated in the first toner supply area 8 still remains in the second toner collection area 12.

Figure 7:
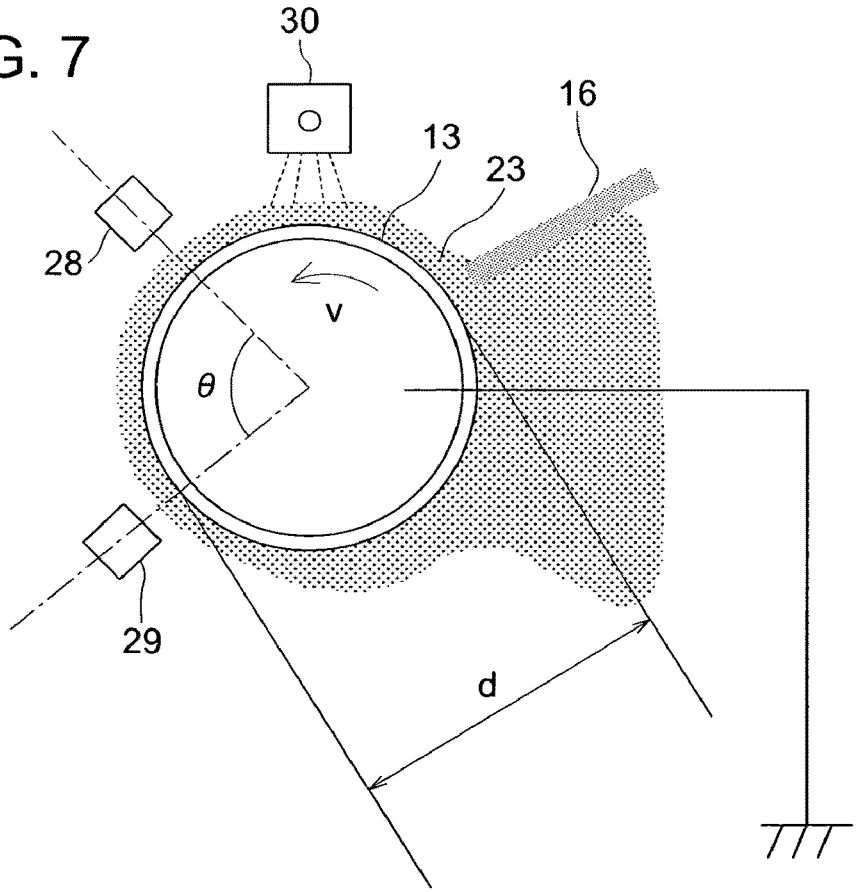
FIG. 7 is a schematic diagram showing a method of measuring the damping time constant $\tau$(=CR) of a developer layer.

It should be noted that t12 is determined by the diameter d of the developer carrier 13, the angle θ formed by the first toner carrier 24, developer carrier 13 and second toner carrier 25, and the peripheral speed v of the developer carrier 13, and t12 can be obtained by calculation (FIG. 7 to be described later). The product of C and R (hereinafter referred to as a damping time constant of developer and represented by τ) can be obtained by actual measurement according to the method to be described later.

By setting the development device in such a way that "t12/τ<10" is satisfied by the t12/τ obtained in the aforementioned manner, the counter-charge having occurred in the developer 23 in the first toner supply area 8 can be still maintained in the developer 23 until being conveyed to the second toner collection area 12 without decreasing to disappear. This charge accelerates the collection of the post-development residual toner on the second toner carrier 25 and reduces the occurrence of development hysteresis (ghost).

From the viewpoint of using the counter-charge to accelerate toner collection, a preferred setting is to ensure that the amount of toner on the first toner carrier is greater than that of the toner on the second toner carrier. This can be achieved by setting the supply bias of the first toner carrier at a higher level.

This is because, if there is an increase in the amount of toner supplied to the first toner carrier on the upstream side, the generation of counter-charge will be increased as much. This contributes to more effective collection of the toner from the second toner carrier on the downstream side.

(How to Measure the Damping Time Constant τ of the Developer Layer)

FIG. 7 is a schematic diagram showing a method of measuring the damping time constant τ(=CR) of the developer layer.

In the development device of FIG. 2, while the developer carrier 13 is rotated with the toner carriers 24 and 25 separated from the developer carrier 13, an electric charge is supplied, using a scorotron charger 30, to the surface of the developer 23 having passed through the regulating member 16 on the developer carrier 13. The developer carrier 13 is kept grounded.

In this situation, the surface of the developer 23 is charged as if it has the counter-charge immediately after supplying toner. The charged potential is preferably in the range of about 200 through 1,000 volts.

After that, a surface potential is measured with first and second surface potentiometers 28 and 29 disposed at respective two positions facing the developer layer, where the potential of the developer layer measured with the first surface potentiometer 28 is assumed as V1(V) and the potential of the developer layer measured with the second surface potentiometer 29 is assumed as V2(V).

V1 measured with the first surface potentiometer 28 decreases according to Equation (1), similarly to the decrease of the counter-charge. Assuming V0 in the Equation (1) as V1 in this case, and taking CR=τ into account, the following Equation (2) holds:

$$V(t)=V1\times\exp(-t/\tau) \quad (2)$$

Referring to Equation (2), T(s) is assumed as he time required for the developer carrier 13 to rotate from the opposing portion facing the first surface potentiometer 28 to the opposing portion facing the second surface potentiometer 29. Since the surface potential at the time t=T is V2, the following Equation (3) holds for the potential V2 measured with the second surface potentiometer 29:

$$V2=V1-\exp(-T/\tau) \quad (3)$$

Further, T can be obtained according to the following Equation (4) from the rotational speed v (mm/s) of the developer carrier 13, diameter d (mm) of the developer carrier 13, and the angle θ (degrees) formed by the first toner carrier 24, developer carrier 13 and second toner carrier 25.

$$T=(\pi/360)\times(d\theta/v) \quad (4)$$

Thus, τ can be represented by the following Equation (5). τ can be obtained from the conditions d, θ and v at the time of measurement, and detection values V1 and V2 of the surface potentiometer.

$$\tau=T/(\log V1-\log V2) \quad (5)$$

wherein T=(π/360)×(dθ/v)

Example

Using the image forming apparatus of the embodiment shown in FIG. 1, the following experiments were conducted to verify the advantages.

(Test 1)

Examples 1 through 6 and Comparative Examples 1 through 3 uses the developers having different carrier types, i.e., having different damping time constants τ(=CR). The details are given in Table 1.

Examples 1 through 3 fail to satisfies the relationship. For these Examples and Comparative Examples, evaluation images were printed out to evaluate the ghost.

Figure 8:
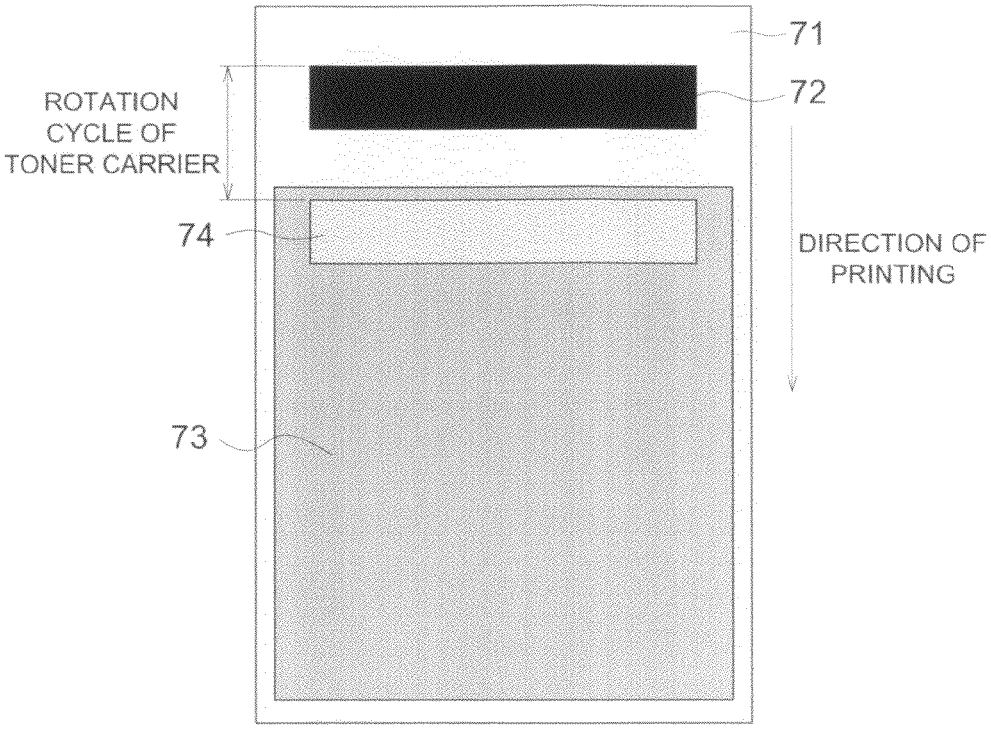
FIG. 8 is a pattern diagram showing an example of an image outputted to evaluate a ghost.

A ghost evaluation chart was printed out. FIG. 8 shows the evaluation chart that shows an example of the development hysteresis (ghost). Visual observation reveals that the ghost 74 occurred in the half-tone background portion 73 downstream, by the distance corresponding to one rotation cycle of the first and second toner carriers, from the solid black background 72 in the solid white background 71.

TABLE 1

| | Carrier type | Damping time constant τ (=CR) | Developer carrier Speed (mm/s) | Developer carrier Diameter (mm) | Angle (degrees) | t12 (s) | t12/τ | Conditions t12/τ < 10 | Residual surface-potential ratio (%) | Ghost occurrence |
|---|---|---|---|---|---|---|---|---|---|---|
| *1 | I | 3.1E+02 | 500 | 30 | 60 | 0.031 | 1.0E−04 | B | 99.99 | A |
| *2 | H | 3.6E+01 | 500 | 30 | 60 | 0.031 | 8.8E−04 | B | 99.91 | A |
| *3 | G | 8.9E+00 | 500 | 30 | 60 | 0.031 | 3.5E−03 | B | 99.65 | A |
| *4 | F | 4.5E−01 | 500 | 30 | 60 | 0.031 | 7.1E−02 | B | 93.18 | A |
| *5 | E | 4.5E−02 | 500 | 30 | 60 | 0.031 | 7.1E−01 | B | 49.36 | B |
| *6 | D | 2.7E−02 | 500 | 30 | 60 | 0.031 | 1.2E+00 | B | 30.83 | B |
| Comp. 1 | C | 1.3E−03 | 500 | 30 | 60 | 0.031 | 2.4E+01 | C | 0.00 | C |
| Comp. 2 | B | 1.3E−03 | 500 | 30 | 60 | 0.031 | 2.4E+01 | C | 0.00 | C |
| Comp. 3 | A | 1.3E−04 | 500 | 30 | 60 | 0.031 | 2.4E+02 | C | 0.00 | C |

*Example,
Comp.: Comparative example

The carriers were produced according to different production methods being used as developers. Table 1 shows the value of damping time constant τ of the developer measured according to different methods, various forms of system conditions, the values for t12 and t12/CR obtained from the system conditions thereof, the residual surface-potential ratio in the second toner collection area calculated therefrom, and the result of evaluating the ghost of the image.

Carries A through I are produced by coating with styrene acryl resin the magnetic core obtained by baking the manganese oxide and iron oxide. The core manufacturing conditions and the thickness of the coated resin were varied so as to get different resistances.

Carries A through I were arranged in such a way that the resistances thereof got greater with that order. The result is that the values of τ(=CR) were increased with the order from A through I. In this case, the value of τ(=CR) was varied mainly by varying the resistances of the carrier in the developer.

In the visual observation, "A" indicates that no ghost is shown at all; "B" indicates that an obscure shape of a ghost is shown without substantial image quality problems; and "C" indicates that the shape of the clear ghost, hence an image quality problem, is clearly shown.

As will be apparent from Table 1, when t12/τ is smaller than 10 as in Examples 1 through 6, "A" or "B" is the result of evaluation. In these cases, occurrence of a ghost is reduced. When "t12/τ" is smaller than 0.1 as in Examples 1 through 4, the evaluation is excellent ("A"). The Comparative Examples 1 through 3 failing to satisfy the aforementioned conditions were bad ("C").

(Test 2)

In Examples 7 through 11 and Comparative Examples 4 through 7, image formation speeds (developer carrier speeds) were varied for developers using three types of carriers so as to get different damping time constants τ(=CR). The details are illustrated in Table 2.

TABLE 2

| | Carrier type | Damping time constant τ (=CR) | Developer carrier Speed (mm/s) | Developer carrier Diameter (mm) | Angle (degrees) | t12 (s) | t12/τ | Conditions t12/τ < 10 | Residual surface-potential ratio (%) | Ghost occurrence |
|---|---|---|---|---|---|---|---|---|---|---|
| *7 | G | 8.9E+00 | 1000 | 30 | 60 | 0.016 | 1.8E−03 | B | 99.82 | A |
| *8 | G | 8.9E+00 | 500 | 30 | 60 | 0.031 | 3.5E−03 | B | 99.65 | A |
| *9 | G | 8.9E+00 | 30 | 30 | 60 | 0.524 | 5.9E−02 | B | 94.29 | A |
| *10 | E | 4.5E−02 | 1000 | 30 | 60 | 0.016 | 3.5E−01 | B | 70.26 | B |
| *11 | E | 4.5E−02 | 500 | 30 | 60 | 0.031 | 7.1E−01 | B | 49.36 | B |
| Comp.4 | E | 4.5E−02 | 30 | 30 | 60 | 0.524 | 1.2E+01 | C | 0.00 | C |
| Comp.5 | C | 1.3E−03 | 1000 | 30 | 60 | 0.016 | 1.2E+01 | C | 0.00 | C |
| Comp.6 | C | 1.3E−03 | 500 | 30 | 60 | 0.031 | 2.4E+01 | C | 0.00 | C |
| Comp.7 | C | 1.3E−03 | 30 | 30 | 60 | 0.524 | 3.9E+02 | C | 0.00 | C |

*Example,
Comp.: Comparative example

As shown in FIG. 1, Examples 1 through 6 satisfies the requirements of "t12/τ<10", while the Comparative Three types of carriers, C, E and G are picked up from the carriers used for Table 1, and the image formation speed was varied so that t12 were varied. Then the same evaluation as that shown in Table 1 was conducted. The result is shown in Table 2.

When the image formation speed was varied, the peripheral speed of the developer carrier was varied in the range of 30 through 1000 mm/s. This was followed by the variation in the value of t12 and t12/τ. In this situation, the value of τ(=CR) is the same when the carrier type is the same. When "t12" was varied, the value of t12/τ was varied.

As shown in Table 2, Examples 7 through 11 satisfied the conditions of "t12/τ<10". Comparative Examples 4 through 7 failed to satisfy the conditions. For these Examples and Comparative Examples, the evaluation images were printed out to perform ghost evaluation, similarly to the case of Table 1.

Similarly to the case of Table 1, "A" or "B" was the evaluation result in Examples 7 through 11 wherein "t12/τ<10" was satisfied. This shows that the occurrence of ghosts was reduced. When t12/τ<0.1 was satisfied as in Examples 7 through 9, the result was particularly excellent ("A"). "C" was the evaluation result for Comparative Examples 4 through 7 failing to satisfy the aforementioned conditions.

Figure 9:
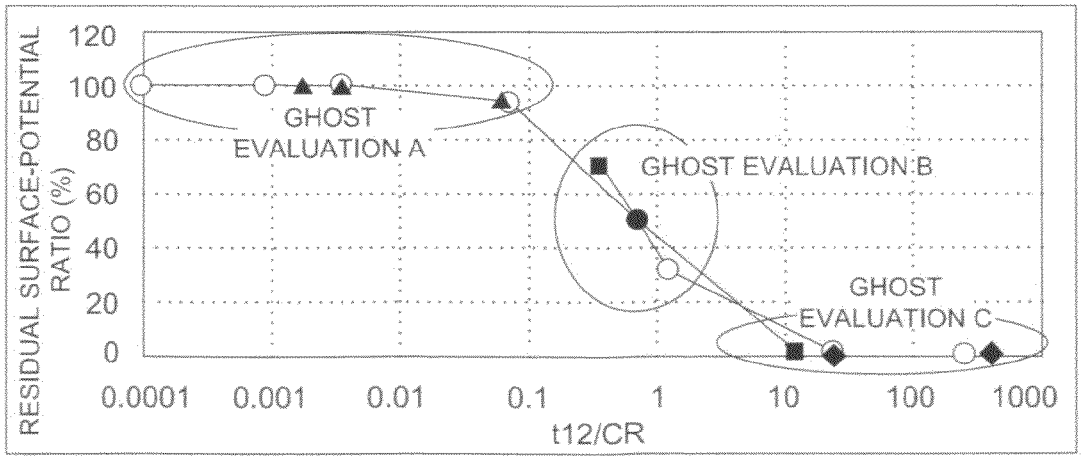
FIG. 9 is a chart showing the relationship between the value of $t12/\tau$, residual surface-potential ratio and ghost evaluation result with respect to the value of $t12/\tau$.

The value of t12/τ in the aforementioned Tables 1 and 2, and the calculation value of the residual surface-potential ratio at that time were plotted on a chart, and a ghost evaluation result was registered for each of them. The result is shown in the chart of FIG. 9.

A circle indicates a plot of the results of Table 1. An oblique solid square shows a plot of the results of carrier type C in Table 2. A solid square denotes a plot of the results of carrier type E in Table 2. A solid triangle represents a plot of the results of carrier type G in Table 2.

In any case, the residual surface-potential ratio is higher in the area wherein t12/τ<10 is satisfied, and the occurrence of ghosts is reduced accordingly.

As described above, according to the development device of the present embodiment and image forming apparatus using the same, in a hybrid development method wherein a plurality of toner carriers are provided, counter-charge having occurred in the developer remains in the developer without decreasing to disappear until the developer moves to the second toner carrier in the downstream-side, wherein this counter-charge is caused by supplying toner to the first toner carrier upstream in the rotating direction of the developer carrier.

This structure accelerates the collection of the post-development residual toner on the toner carrier and reduces the reduction of density in high-speed development mode, thereby providing a high quality image wherein the occurrence of development hysteresis (ghost) is reduced.

The aforementioned embodiments should be considered in all respects as illustrative and not restrictive, the scope of the invention being indicated by the appended claims rather than by the foregoing description. All changes that come within the meaning and range of equivalency of the claims are therefore intended to be embraced in the invention.

What is claimed is:

1. A developing device, comprising:

a first toner carrier for carrying toner on a surface thereof, to develop with the toner, an electrostatic latent image formed on an image carrier;

a second toner carrier for carrying toner on a surface thereof to develop with the toner, the electrostatic latent image formed on the image carrier; and a developer carrier that faces the first toner carrier and the second toner carrier, and is adapted to carry developer in a thin layer on a surface thereof to supply toner contained in the developer to the first toner carrier and the second toner carrier;

wherein the first toner carrier is disposed so as to face the developer carrier at an upstream position relative to a rotating direction of the developer carrier;

wherein the second toner carrier is disposed so as to face the developer carrier at a downstream position relative to the rotating direction of the developer carrier, wherein a counter-charge generated by the supply of toner from the developer on the developer carrier in the developer at a first facing area between the developer carrier and the first toner carrier, remains without decreasing to a zero level in the developer until the counter-charge is conveyed to a second facing area between the developer carrier and the second toner carrier; and the following relationship is satisfied:

$$t12/\tau<10;$$

where τ is a damping time constant of surface charge on the thin layer of the developer carried and conveyed on the developer carrier; and where t12 is a time taken for the developer on the developer carrier to travel from the first facing area to the second facing area.

2. The developing device of claim 1, wherein τ and t12 satisfy the following relationship:

$$t12/\tau<0.1.$$

3. The developing device of claim 1, wherein an amount of the toner carried on the first toner carrier is greater than an amount of the toner carried on the second toner carrier.

4. The developing device of claim 1, wherein a gap at the nearest portion between the second toner carrier and the developer carrier is smaller than a gap at the nearest portion between the first toner carrier and the developer carrier.

5. A developing device, comprising:

a first toner carrier for carrying toner on a surface thereof to develop with the toner an electrostatic latent image formed on an image carrier a second toner carrier for carrying toner on a surface thereof to develop with the toner the electrostatic latent image formed on the image carrier;

a developer carrier that faces the first toner carrier and the second toner carrier, and is adapted to carry developer in a thin layer shape on a surface thereof to supply toner contained in the developer to the first toner carrier and the second toner carrier, wherein the first toner carrier is disposed so as to face the developer carrier at an upstream position relative to a rotating direction of the developer carrier;

wherein the second toner carrier is disposed so as to face the developer carrier at a downstream relative to the rotating direction of the developer carrier;

wherein a counter-charge generated by the supply of toner from the developer on the developer carrier in the developer at a first facing area between the developer carrier and the first toner carrier, remains without decreasing to a zero level in the developer until the counter-charge is conveyed to a second facing area between the developer carrier and the second toner carrier; and wherein the surface of the first toner carrier or the surface of the second toner carrier travel in opposite directions relative to a traveling direction of the surface of the developer carrier in the first facing area or the second facing area, respectively.

6. An image forming apparatus, comprising:

an image carrier;

a latent image forming section for forming an electrostatic latent image on the image carrier;

a first toner carrier for carrying toner on a surface thereof to develop with the toner the electrostatic latent image on the image carrier;

a second toner carrier for carrying toner on a surface thereof to develop with the toner the electrostatic latent image formed on the image carrier; and a developer carrier which is provided so as to face the first toner carrier and the second toner carrier and is adapted to carry developer in a thin layer shape on a surface thereof to supply toner contained in the developer to the first toner carrier and the second toner carrier;

wherein the first toner carrier is disposed so as to face the developer carrier at an upstream position relative to a rotating direction of the developer carrier; and wherein the second toner carrier is disposed so as to face the developer carrier at a downstream position relative to the rotating direction of the developer carrier;

wherein counter-charge generated by the supply of toner from the developer on the developer carrier in the developer at a first facing area between the developer carrier and the first toner carrier remains in the developer without decreasing to a zero level disappear until the counter-charge is conveyed to a second facing area between the developer carrier and the second toner carrier; and wherein the following relationship is satisfied:

$$t12/\tau<10$$

where:

$\tau$ is a damping time constant of surface charge on the thin layer of the developer carried and conveyed on the developer carrier; and t12 is a time taken for the developer on the developer carrier to travel from the first facing area to the second facing area.

7. The image forming apparatus of claim 6, wherein the first toner carrier is disposed upstream of the second toner carrier in a rotating direction of the image carrier.

* * * * *

UNITED STATES PATENT AND TRADEMARK OFFICE

CERTIFICATE OF CORRECTION

PATENT NO. : 8,200,130 B2
APPLICATION NO. : 12/592790
DATED : June 12, 2012
INVENTOR(S) : Takeshi Maeyama et al.

It is certified that error appears in the above-identified patent and that said Letters Patent is hereby corrected as shown below:

In the Claims

In column 18, claim 5, line 41, immediately after "image carrier" insert --;--.

In column 19, claim 6, line 18, after "developer carrier;" delete "and".

In column 20, claim 6, line 5, after "to a zero level" delete "disappear".

Signed and Sealed this
Sixteenth Day of July, 2013

Teresa Stanek Rea
*Acting Director of the United States Patent and Trademark Office*